US008397736B2

(12) United States Patent
Coker et al.

(10) Patent No.: US 8,397,736 B2
(45) Date of Patent: Mar. 19, 2013

(54) APPLIANCE PUMP

(75) Inventors: Clinton Coker, Dunedin (NZ); Rob Lawrence, Dunedin (NZ); Gareth Hargreaves, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 1278 days.

(21) Appl. No.: 12/175,962

(22) Filed: Jul. 18, 2008

(65) Prior Publication Data

US 2009/0028700 A1 Jan. 29, 2009

Related U.S. Application Data

(60) Provisional application No. 60/951,279, filed on Jul. 23, 2007.

(51) Int. Cl.
*A47L 15/42* (2006.01)
*F04D 29/66* (2006.01)

(52) U.S. Cl. ..... 134/186; 415/206; 417/423.14

(58) Field of Classification Search ..... 134/186
See application file for complete search history.

(56) References Cited

U.S. PATENT DOCUMENTS

| | | | | |
|---|---|---|---|---|
| 2,015,200 | A | 9/1935 | Spoor | |
| 4,591,311 | A | 5/1986 | Matsuda et al. | |
| 6,095,776 | A * | 8/2000 | Maki | 418/45 |
| 6,116,850 | A | 9/2000 | Yu | |
| 6,149,407 | A | 11/2000 | Laing | |
| 6,398,495 | B1 * | 6/2002 | Kazianus | 415/206 |
| 6,665,909 | B2 | 12/2003 | Collins et al. | |
| 6,767,181 | B2 | 7/2004 | Yu et al. | |
| 7,008,174 | B2 | 3/2006 | Yu et al. | |

FOREIGN PATENT DOCUMENTS

| | | | |
|---|---|---|---|
| EP | 1208790 A2 | * | 5/2002 |
| JP | 53071302 A | * | 6/1978 |
| WO | WO93/12706 | * | 7/1993 |

* cited by examiner

*Primary Examiner* — Michael Barr
*Assistant Examiner* — Jason Riggleman
(74) *Attorney, Agent, or Firm* — Clark Hill PLC

(57) ABSTRACT

A pump for washing appliance is described. The pump has a pump casing in which an impeller is located. The pump casing has an inlet and outlet, and an inlet conduit extending from the inlet at a small angle above the horizontal. The ceiling includes a downwardly extending dividing wall section extending radially from a central location to a side wall of the casing. The dividing wall is positioned between the inlet outlet. The ceiling incorporates a ramped surface rising around the central location, between the outlet side and the inlet side of the dividing wall. The ramped surface is higher adjacent the inlet side than the outlet side of the dividing wall section so that when the impeller is not rotating, air inside the pump chamber will rise up the ramped surface through the inlet and up the inlet conduit.

19 Claims, 5 Drawing Sheets

APPLIANCE PUMP

BACKGROUND OF THE INVENTION

1. Field of the Invention

This invention relates to pumps used in washing appliances.

2. Description of the Prior Art

Drain pumps and wash pumps are used in washing appliances such as dishwashers. During the operation of a washing appliance air can be introduced into the pump housing. Air can build up to such an extent that liquid priming of the pump may be impeded or even prevented.

A dishwasher drain pump is disclosed in U.S. Pat. No. 6,398,495. The drain pump is designed in a way that allows air trapped in the pump impeller chamber to be bled out of the pump soil pipe. However, the pump design does not allow all trapped air to be bled off, such that a level of air can remain trapped in the impeller chamber. The pump impeller is designed to overcome the level of air that can remain trapped, to allow adequate priming of the pump. While this drain pump operates satisfactorily, the efficiency of the pump can be affected by the level of air that can remain trapped.

SUMMARY OF THE INVENTION

It is an object of the present invention to provide a pump for a washing appliance that goes someway to improving on the above pump, or which will at least provide the industry with a useful choice.

According to one aspect the present invention may broadly be said to consist in a pump for a washing appliance including a wash chamber, comprising:

- a pump casing having a substantially cylindrical side wall, a bottom wall and a ceiling, the pump casing being adapted to receive water from said wash chamber;
- an inlet and an outlet in the side wall spaced apart circumferentially about the side wall;
- an inlet conduit at the inlet extending from the pump casing at a small angle above the horizontal;
- a pump impeller in the casing adjacent the bottom wall, the pump impeller having vanes extending to the side wall; wherein
- the ceiling includes a downwardly extending dividing wall section extending radially from a central location to the side wall;
- the dividing wall having an inlet side adjacent said inlet and an outlet side adjacent said outlet; and
- the ceiling incorporating a ramped surface rising around said central location between the outlet side and the inlet side of the dividing wall, the ramped surface higher adjacent the inlet side than the outlet side;
- the upper most periphery of the inlet being above or substantially flush with the ramped surface adjacent the inlet side of the dividing wall section so that when the impeller is not rotating, air inside the pump chamber will rise up the ramped surface through the inlet and up the inlet conduit.

Preferably the ceiling has a downwardly extending central hub through which the said drive shaft passes.

Preferably the ramped surface extends between the central hub of the ceiling and the side wall.

Preferably the ramped surface rises at a continuous rate between the outlet side and the inlet side of the dividing wall.

Preferably the impeller comprises:

- a central impeller hub and a plurality of vanes extending radially from the impeller hub,
- an upper surface of the impeller hub closely adjacent an under surface of the central location of the ceiling, and
- a lower surface of the impeller hub closely adjacent a central area of the bottom wall, and
- the vanes closely adjacent the bottom wall and the side wall, and
- an upper surface of the vanes closely adjacent an under surface of the dividing wall section of the ceiling as the vanes rotate across the dividing wall section,
- the impeller being made from an elastic material.

Preferably the pump casing is fixed to and in communication with a sump in the floor of the wash chamber.

Preferably the casing is formed in and integral with the floor of the wash chamber.

Preferably the inlet and the outlet are substantially located side-by-side in the side to wall.

Preferably the inlet and the outlet are circular in cross-section.

Preferably the lower most periphery of the inlet and the outlet are substantially flush with the bottom wall.

Preferably a rotational axis of the impeller is substantially vertical, the cylindrical side wall is substantially vertical, and the bottom wall is substantially horizontal.

Preferably the inlet is inclined at an inclination of approximately 6° from the horizontal.

Preferably the washing appliance is a drawer style dish washer, the wash chamber being slidably mounted within a cabinet.

In a further aspect, the present invention may broadly consist in a washing appliance including a wash chamber having a sump where wash water collects and, a pump as set out above, with the inlet conduit extending to the sump.

Preferably the washing appliance is a drawer style dish washer, the wash chamber being slidably mounted within a cabinet.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The term "comprising" as used in this specification and claims means "consisting at least in part of". When interpreting each statement in this specification that includes the term "comprising", features other than that or those prefaced by the term may also be present. Related terms such as "comprise" and "comprises" are to be interpreted in the same manner.

DETAILED DESCRIPTION

Figure 1:
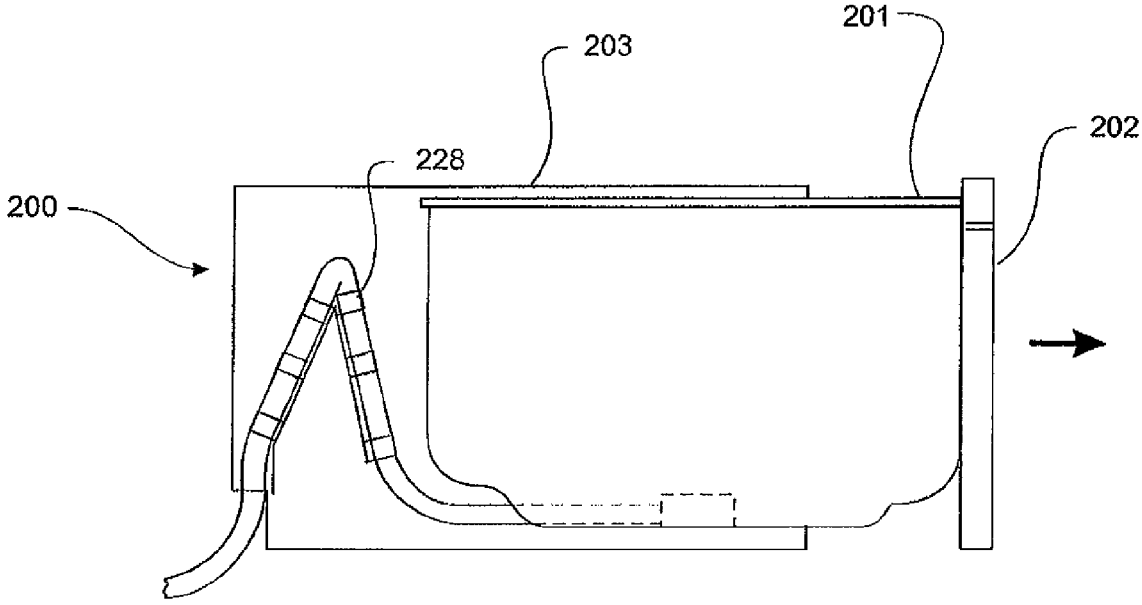
FIG. 1 shows a diagrammatic form of a dishwashing appliance incorporating the pump of the present invention.

The washing appliance 200 incorporating the pump of the present invention is of the type illustrated in FIG. 1. A wash chamber 201 (with all wash system components) fitted with a front panel 202 is slidably mounted within a cabinet 203 in a 'drawer' arrangement. The wash chamber has an open top and is withdrawn from the cabinet in the direction of the arrow to allow loading and unloading of dishes and is retracted into cabinet 203 during washing. The wash and drain systems are fitted within wash chamber 201 including a motor and pumps. Flexible connecting wiring and plumbing 228 couple the wash chamber to the relevant terminations within the cabinet in the manner indicated in FIG. 1. The dishwasher controller may be mounted in the cabinet or in the sliding wash system.

Figure 2:
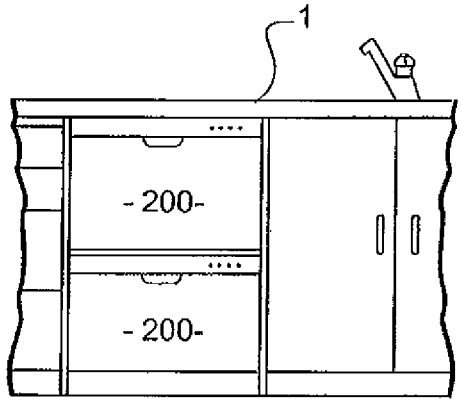
FIG. 2 shows an example of the way in which dishwashing appliances incorporating the pump of the present invention may be mounted in a modular installation in a kitchen installation.
Figure 3:
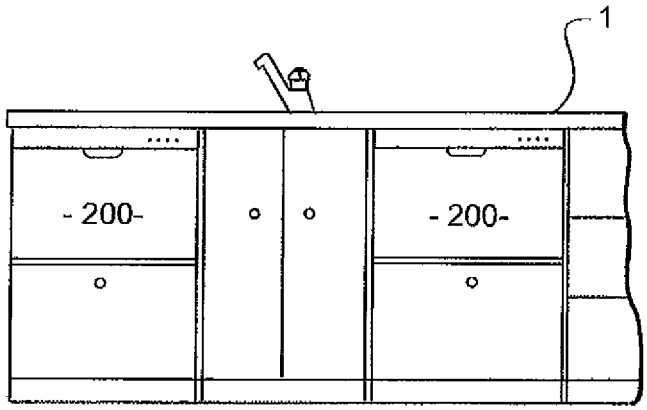
FIG. 3 shows second example of the way in which dishwashing appliances incorporating the pump of the present invention may be mounted in a modular installation in a kitchen installation.
Figure 4:
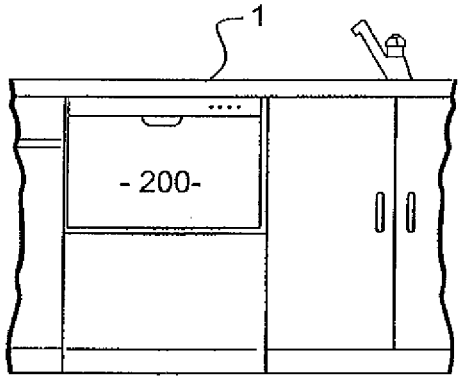
FIG. 4 shows third example of the way in which dishwashing appliances incorporating the pump of the present invention may be mounted in a modular installation in a kitchen installation.

The washing appliance 200 is usually constructed with a height dimension approximately half that of conventional front-loading domestic washing appliances. In this form it can be used alone or as one of a number, more usually one of a pair of such washing appliances. FIGS. 2 to 4 show installation concepts using one or two washing appliances using this modular concept. In FIG. 2, two such washing appliances 200 are shown stacked one above the other under a sink bench 1 which will typically be between 850 and 900 mm above floor level. In FIG. 3 two washing appliances 200 are shown mounted one on either side of a sink forming part of the sink bench 1. In FIG. 4 only a single washing appliance 200 is provided under a sink bench 1.

In order to achieve an effective washing space within the wash chamber 201 of the reduced height washing appliance 200, it is important that the pump of the present invention has a compact vertical height.

Referring to FIGS. 5 to 8 the present washing appliance uses a single motor to drive both the wash pump and the drain pump impellers which are mounted at opposite ends of the motor rotor shaft. The motor rotor rotates within a housing in the washer floor while the motor stator is mounted external to the housing under the sliding wash chamber. The rotor is design to operate while being immersed in water. The wash pump is active when the motor rotates in one direction while the drain pump is active when the motor rotates in the opposite direction.

Figure 5:
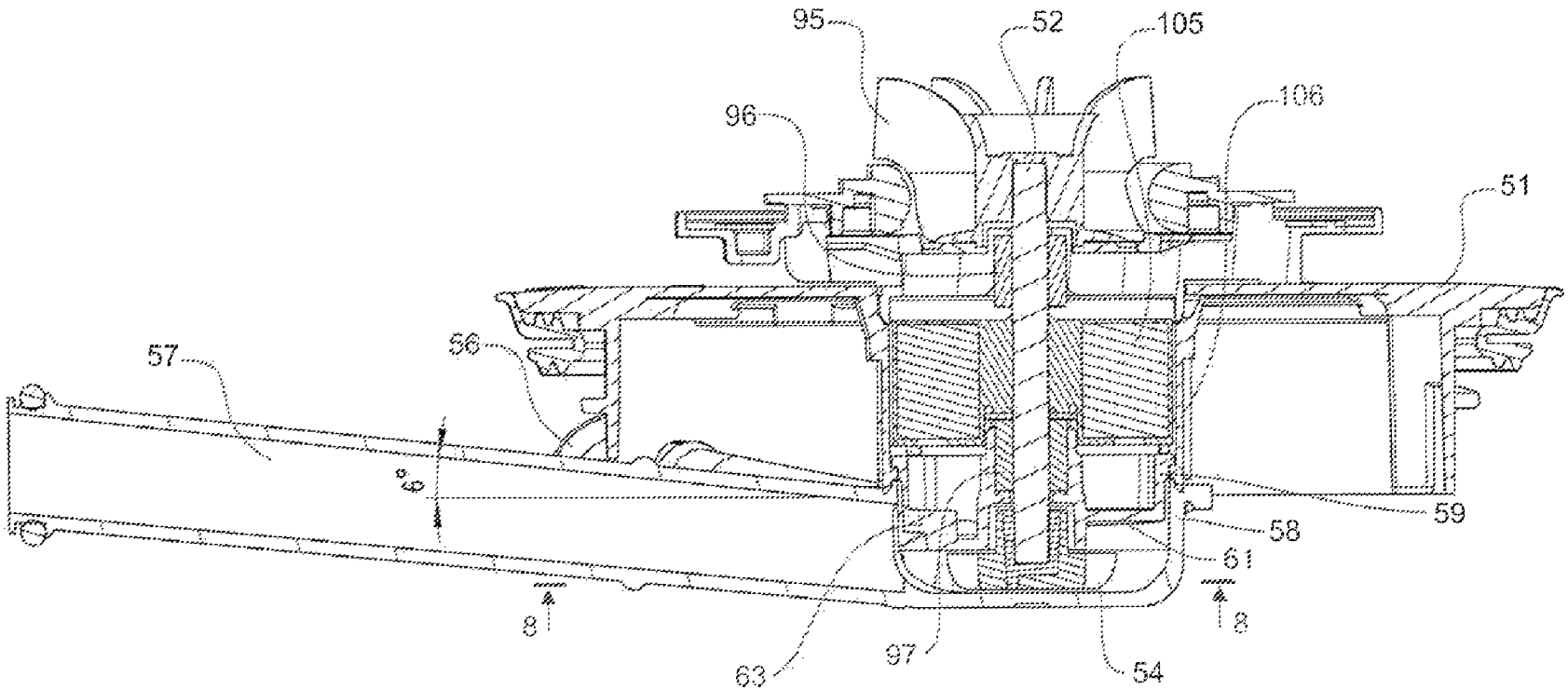
FIG. 5 is a partial sectional view of a dishwashing appliance drain pump.
Figure 7:
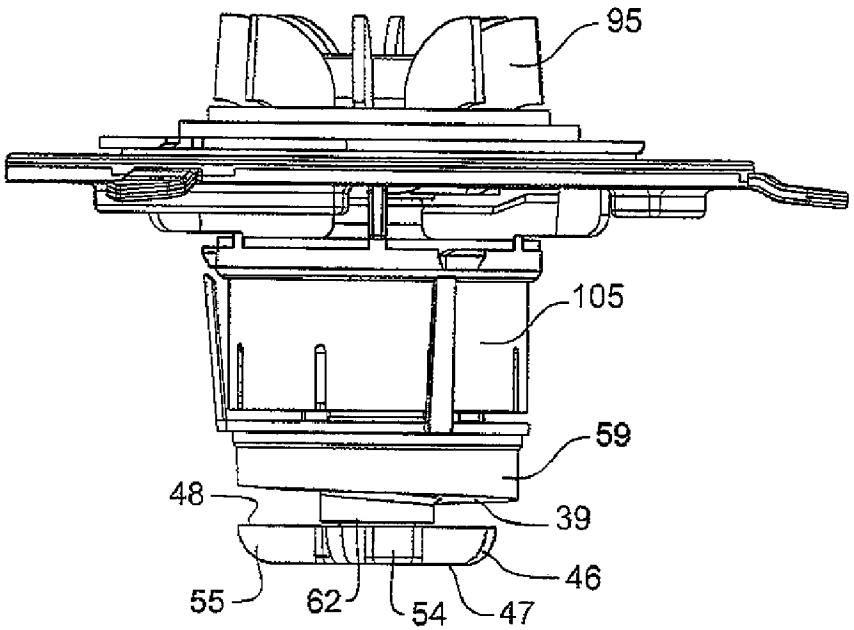
FIG. 7 is a view on the impeller, seal ring and rotor assembly removed from the pump chamber, viewed from the opposite side to that shown in FIG. 6.
Figure 6:
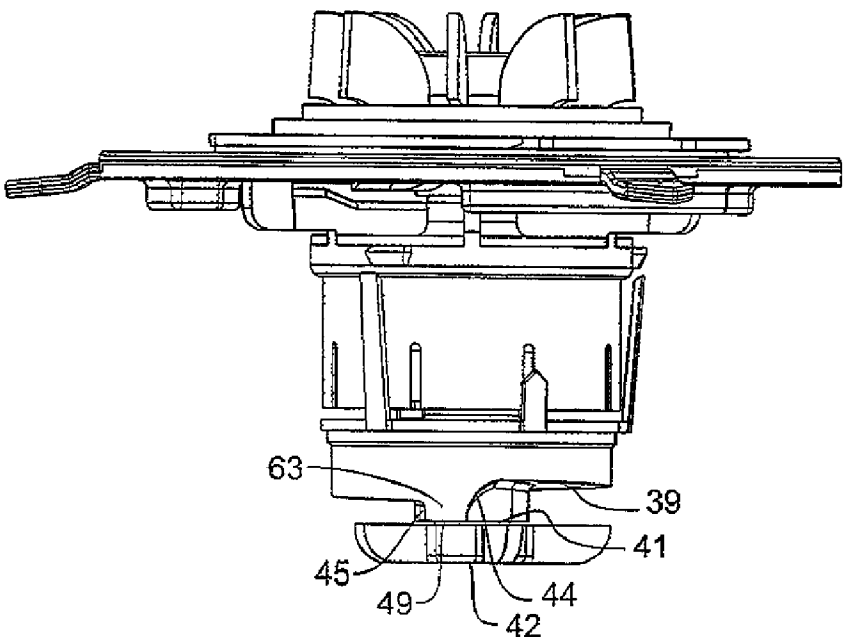
FIG. 6 is a view on the impeller, seal ring and rotor assembly removed from the pump chamber, highlighting the wall section of the seal ring.
Figure 8:
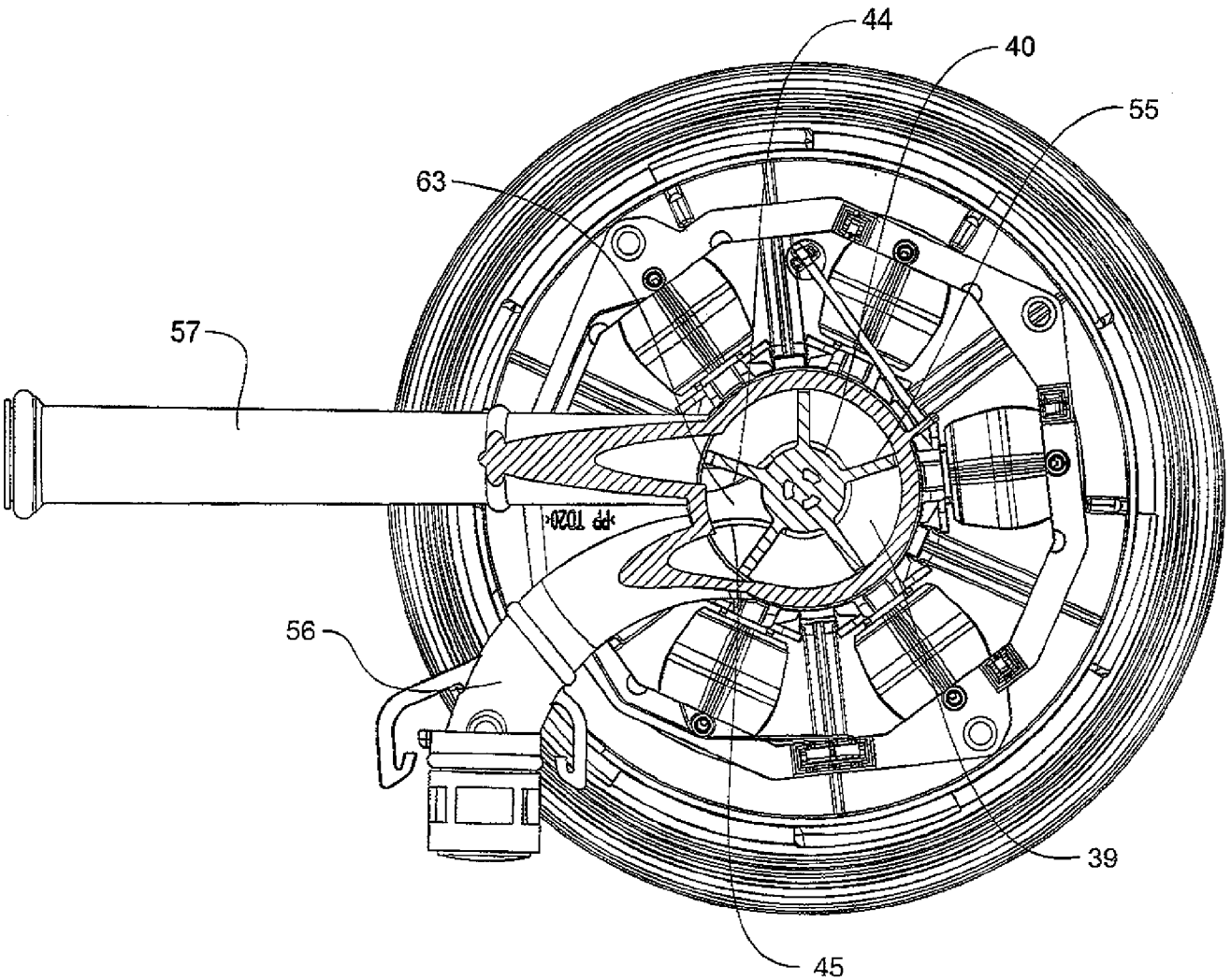
FIG. 8 is a sectional view on the impeller chamber ceiling as indicated in FIG. 5 in the direction of arrows 8-8, and shows the location of the wall section between the inlet and outlet conduits.

In FIG. 5 motor rotor 105 is mounted coaxially within housing 106 provided in removable central floor section 51 of the wash chamber. Rotor 105 is splined with or onto a drive shaft 52 which extends out of the opposite faces of the rotor. The upper portion of drive shaft 52 carries a wash pump impeller 95 (pump casing and spray system not shown), while the lower section of the drive shaft carries a drain pump impeller 54. The shaft 54 is radially supported by bearings 96 and 97. The lower portion 58 of housing 106 provides a casing within which impeller 54 operates to pump wash water draining into a sump in the floor of the washing chamber from the sump and into an outlet conduit 56.

A fluid inlet and a fluid outlet are located side-by-side in the cylindrical side wall of the impeller casing. A fluid inlet conduit 57 at the inlet and a fluid outlet conduit 56 at the outlet have a substantially circular cross-section, the lower most periphery of each conduit is substantially flush with the bottom surface 60 of the impeller casing.

The rotor is designed to operate while immersed in water. However, it is desirable to prevent soiled wash water from entering the gap between housing 106 and rotor 105 so as to reduce wear on the rotor and to eliminate the possibility of jamming the rotor. Sealing ring 59 is mounted on shaft 52 via bearing 97, between the lower face of the rotor 105 and the upper most edge surface of the impeller. Sealing ring 59 supports bearing 97 radially and axially. Sealing ring 59 interfaces with the impeller casing to create a substantially sealed chamber in which the drive shaft 52 and impeller 54 rotates. Some water may transfer between the impeller chamber and the chamber in which the rotor is located, via the interface between the sealing ring 59 and the housing 106. A small amount of water transfer may occur between the impeller chamber and the chamber in which the rotor is located, via spacing between the bearing 97 and the shaft 52. The lower surface 61 of the sealing ring 59 forms the ceiling of the impeller chamber.

The lower surface 61 of the sealing ring 59 has a central hub 62 extending downwards into the impeller chamber through which the motor shaft passes. A dividing wall section 63 extends radially from the central hub 62 to the cylindrical side wall 58. The sealing ring 59 is located into the impeller casing so that the wall section 63 is located between the fluid inlet conduit 57 and fluid outlet conduit 56.

The impeller 54 is made from an elastic material such as Santoprene® 241-73W236 and has a plurality of radial vanes 55 connected to a central hub 40. The impeller hub upper surface 41 fits closely adjacent the central location 62 of the sealing ring lower surface, and the impeller hub lower surface 42 fits closely adjacent the central area of the bottom surface 60 of the impeller chamber.

The dividing wall section 63 and central hub 62 of the sealing ring lower surface, and the central hub of the impeller 40, create an annular channel in which the impeller vanes are located. The annular channel begins at the fluid inlet 57 adjacent an inlet side 44 of the dividing wall section 63 and continues circumferentially around the sealing ring lower surface central hub and the impeller hub 40 to terminate at the fluid outlet 56 adjacent an outlet side 45 of the dividing wall section 63.

The impeller vanes 55 are shaped to fit closely adjacent the profile of the side and bottom surfaces of the impeller chamber to substantially form a seal against fluid flow past the end edge surface 46 and underneath edge surface 47 of the impeller vanes 55.

The upper edge surface of the impeller vanes 48 fit closely adjacent the underside surface 49 of the wall section 63 so that each vane 55 substantially forms a seal against fluid flow between the underside surface of the wall section and the upper edge surface of the impeller vane as each vane strokes across the wall section as the impeller rotates.

When the motor rotates, the rotating impellet creates low fluid pressure adjacent the inlet side 44 of the wall section and high fluid pressure adjacent the outlet side 45 of the wall section.

Under the action of the rotating impeller air can be introduced into the impeller chamber. Air can build up to such an extent that liquid priming of the pump may be impeded or prevented.

This problem is overcome by providing an inclined ramped surface 39 in the sealing ring lower surface, around the central hub 62 of the sealing ring lower surface. The ramped surface is higher adjacent the inlet side of the dividing wall section, and lower adjacent the outlet side of the dividing wall section, and is inclined between the outlet and inlet sides of the dividing wall so that the ramped surface is not perpendicular to the vertical axis of the pump shaft. The ramped surface may be inclined at a continuous rate between the outlet and inlet sides of the dividing wall. The ramped surface may be inclined at an increasing rate between the outlet and inlet sides of the dividing wall; or the ramped surface may be inclined at a decreasing rate between the outlet and the inlet. Alternatively, the ramped surface may be inclined at a constant rate between the outlet and inlet sides of the dividing wall.

The upper most periphery of the substantially circular fluid inlet 57 is above or substantially flush with the tamped surface 39 adjacent the inlet side 44 of the dividing wall section. The fluid inlet conduit leaves the impeller chamber at an inclination of approximately 6° from the horizontal. When the impeller is stationary, any air accumulated in the impeller chamber will rise up the ramped surface 39 of the annular impeller vane channel, through the inlet and up the inclined fluid inlet conduits 57. The drain pump is therefore self-priming as air automatically vents out of the impeller chamber and up the inlet conduit.

The invention claimed is:

1. A pump, for a washing appliance including a wash chamber, comprising:

a pump casing having a substantially cylindrical side wall, a bottom wall and a ceiling, the pump casing being adapted to receive water from said wash chamber;

an inlet and an outlet in the side wall spaced apart circumferentially about the side wall; an inlet conduit at the inlet extending from the pump casing at a small angle above the horizontal;

a pump impeller in the casing adjacent the bottom wall, the pump impeller having vanes extending to the side wall; wherein the ceiling includes a downwardly extending dividing wall section extending radially from a central location to the side wall;

the dividing wall having an inlet side adjacent said inlet and an outlet side adjacent said outlet; and the ceiling incorporating a ramped surface rising around said central location between the outlet side and the inlet side of the dividing wall, the ramped surface higher adjacent the inlet side than the outlet side;

the upper most periphery of the inlet being above or substantially flush with the ramped surface adjacent the inlet side of the dividing wall section so that when the impeller is not rotating, air inside the pump chamber will rise up the ramped surface through the inlet and up the inlet conduit.

2. A pump for a washing appliance according to claim 1 wherein the ceiling has a downwardly extending central hub through which the said drive shaft passes.

3. A pump for a washing appliance according to claim 2 wherein the ramped surface extends between the central hub of the ceiling and the side wall.

4. A pump for a washing appliance according to claim 1 wherein the ramped surface rises at a continuous rate between the outlet side and the inlet side of the dividing wall.

5. A pump for a washing appliance as claimed in any one of claims 1 to claim 4 wherein the impeller comprises:

a central impeller hub and a plurality of vanes extending radially from the impeller hub, an upper surface of the impeller hub adjacent an under surface of the central location of the ceiling, and a lower surface of the impeller hub adjacent a central area of the bottom wall, and the vanes adjacent the bottom wall and the side wall, and an upper surface of the vanes adjacent an under surface of the dividing wall section of the ceiling as the vanes rotate across the dividing wall section, the impeller being made from an elastomeric material.

6. A pump for a washing appliance as claimed in claim 1 wherein the pump casing is fixed to an in communication with a sump in the floor of the washer chamber.

7. A pump for a washing appliance as claimed in claim 6 wherein the casing is formed in and integral with the floor of the wash chamber.

8. A pump for a washing appliance as claimed in claim 1 wherein the inlet and the outlet are substantially located side-by-side in the side wall.

9. A pump for a washing appliance as claimed in claim 1 wherein the inlet and the outlet are circular in cross-section.

10. A pump for a washing appliance as claimed in claim 1 wherein the lower most periphery of the inlet and the outlet are substantially flush with the bottom wall.

11. A pump for a washing appliance as claimed in claim 1 wherein a rotational axis of the impeller is substantially vertical, the cylindrical side wall is substantially vertical, and the bottom wall is substantially horizontal.

12. A pump for a washing appliance as claimed in claim 1 wherein the inlet is inclined at an inclination of approximately 6° from the horizontal.

13. A pump for a washing appliance as claimed in claim 1 wherein the washing appliance is a drawer style dish washer, the wash chamber being slidably mounted within a cabinet.

14. A washing appliance including a washing chamber having a sump where wash water collects and, a pump as claimed in any one of claims 1 to 4, with the inlet conduit extending to the sump.

15. A washing appliance including a washing chamber having a sump where wash water collects and, a pump as claimed in claim 5, with the inlet conduit extending to the sump.

16. A washing appliance including a washing chamber having a sump where wash water collects and, a pump as claimed in any one of claims 6 to 12, with the inlet conduit extending to the sump.

17. A washing appliance as claimed in claim 14 wherein the washing appliance is a drawer style dish washer, the wash chamber being slidably mounted within a cabinet.

18. A washing appliance as claimed in claim 15 wherein the washing appliance is a drawer style dish washer, the washer chamber being slidably mounted within a cabinet.

19. A washing appliance as claimed in claim 16 wherein the washing appliance is a drawer style dish washer, the wash chamber being slidably mounted within a cabinet.

* * * * *